US007377663B2

(12) United States Patent
Desjardin

(10) Patent No.: US 7,377,663 B2
(45) Date of Patent: May 27, 2008

(54) VERSATILE GARMENT FOR ENHANCING THE SAFETY OF PERSONNEL IN LOW-LIGHT CONDITIONS

(75) Inventor: Charmaine Desjardin, Duluth, GA (US)

(73) Assignee: Paul Decker, Norfolk, VA (US)

( * ) Notice: Subject to any disclaimer, the term of this patent is extended or adjusted under 35 U.S.C. 154(b) by 0 days.

(21) Appl. No.: 11/171,715

(22) Filed: Jun. 30, 2005

(65) Prior Publication Data

US 2008/0043458 A1 Feb. 21, 2008

(51) Int. Cl.
*F21V 7/00* (2006.01)

(52) U.S. Cl. ..... 362/103; 362/108; 362/297; 362/346

(58) Field of Classification Search ..... 362/103, 362/108, 297, 249, 346, 184, 235, 105, 800; 2/69, 102, 103
See application file for complete search history.

(56) References Cited

U.S. PATENT DOCUMENTS

| | | | | |
|---|---|---|---|---|
| 4,328,533 | A | 5/1982 | Paredes | 362/108 |
| 4,523,258 | A | 6/1985 | Morse et al. | 362/108 |
| 4,709,307 | A | 11/1987 | Branom | 362/103 |
| 5,070,436 | A | 12/1991 | Alexander et al. | 362/108 |
| 5,249,106 | A | 9/1993 | Barnes et al. | 362/108 |
| 5,424,922 | A | 6/1995 | Wise | 362/32 |
| 5,535,106 | A | 7/1996 | Tangen | 362/108 |
| 5,570,945 | A | 11/1996 | Chien et al. | 362/84 |
| 5,632,549 | A | 5/1997 | Fang | 362/108 |
| 5,690,411 | A | 11/1997 | Jackman | 362/103 |
| 5,779,348 | A | 7/1998 | Interlicchio | 362/108 |
| 5,984,488 | A | 11/1999 | Tung | 362/108 |
| 6,059,414 | A | 5/2000 | Tsai | 359/516 |
| 6,085,698 | A | 7/2000 | Klein | 119/859 |
| 6,086,213 | A | 7/2000 | Holce | 362/84 |
| 6,106,130 | A | 8/2000 | Harding | 362/108 |
| 6,146,006 | A | 11/2000 | Cross | 362/555 |
| 6,267,482 | B1 | 7/2001 | Miller et al. | 362/103 |
| 6,517,214 | B1 | 2/2003 | Mitchell, Jr. et al. | 362/108 |

(Continued)

FOREIGN PATENT DOCUMENTS

JP 7121130 5/1995

(Continued)

OTHER PUBLICATIONS

GSA Blackhawk Products Group, "LedTronics Lighted Safety Vest", http://store.botachtactical.com/ledligsafves.html.

(Continued)

*Primary Examiner*—Thomas M Sember
(74) *Attorney, Agent, or Firm*—Duncan G Byers P.C.

(57) ABSTRACT

Safety garments and safety vests are for enhancing the visibility of a wearer in low-light conditions. The safety garment has a first layer, a reflective layer, and a plurality of lights electrically connected to a power source. The lights are attached to the reflective layer and positioned within an aperture of a protective cover such that the light does not protrude past an outer surface of the protective cover. The reflective layer may be removable. The lights may emit non-visible light. The garment may comprise an audible alarm, a pouch for packing and carrying the garment, a removable lighted patch for displaying any one of various messages or beacons, and fiber-optic thread to further illuminate the safety garment.

22 Claims, 5 Drawing Sheets

U.S. PATENT DOCUMENTS

| | | | | |
|---|---|---|---|---|
| 6,619,831 | B2 | 9/2003 | Kanesaka | 362/555 |
| 6,769,138 | B2 | 8/2004 | Golle et al. | 2/102 |
| 6,834,395 | B2 | 12/2004 | Fuentes | 2/69 |
| 2004/0062032 | A1 | 4/2004 | Mass | 362/84 |
| 2006/0072047 | A1* | 4/2006 | Sekiguchi | 349/25 |

FOREIGN PATENT DOCUMENTS

| | | |
|---|---|---|
| JP | 8041706 | 2/1996 |
| JP | 9209204 | 8/1997 |
| JP | 2002212815 | 7/2002 |

OTHER PUBLICATIONS

CST/berger, "Lighted Safety Vest", http://www.cstsurvey.com/Products/Safety&Bags/SafetySupplies.htm.

Neon Trim, "Lighted Safety Vests!", http://www.neontrim.com/vest.html.

That's Cool Wire, "Power safety vests with yellow Flex Wire™ lighting", http://www.thatscoolwire.com/safety-vests.asp.

Myles Accessories, "LED Flashing Light Vest", http://www.myles-rec.com/Transportation/rodon/Safety%20Vest/led_flashing_light_vest.htm.

PolyBrite International, "PlyBrite Hunting Products", http://www.polybrite.com/hunting.htm.

* cited by examiner

VERSATILE GARMENT FOR ENHANCING THE SAFETY OF PERSONNEL IN LOW-LIGHT CONDITIONS

FIELD OF THE INVENTION

Embodiments of the invention relate generally to the field of safety garments and safety devices. More particularly, embodiments of the invention relate to a safety garment and safety vest for enhancing the visibility of a wearer in low-light conditions and for providing the wearer with a versatile garment that is adaptable to varying applications.

BACKGROUND OF THE INVENTION

There are many occupations, sports, and hobbies that require specific safety measures in order to prevent injury. Many of these measures rely on increasing the visibility of a user or location. Specifically, brightly colored vests worn to increase a the visibility of a person are typically worn by many workers to enhance their safety. Police officers often wear safety vests when directing traffic or working an accident scene. These vests are often worn over their garments and are made in high-visibility colors such as neon orange, yellow, or green. To increase visibility, these vests often include reflective tape to reflect the light from car headlights when used at night. Likewise, similar safety vests are worn by Department of Transportation personnel and many other persons whose occupations require them to work in close proximity to highways and other areas of high vehicular traffic. Additionally, airport personnel use high-visibility safety vests when working on the ramp area around aircraft.

Another segment of society that often utilize high-visibility safety vests are people participating in sports such as hunting, fishing, cycling, and running. All of these sports rely on these vests to highlight the participant in order to protect them from being shot by other hunters or hit by vehicles whose drivers would not otherwise see them without a safety vest. Another benefit of using safety vests when participating in certain sports is to allow the wearers to be more closely tracked to prevent them or their companions from becoming lost. Hunters and fishermen often hunt and fish with others, but may become separated as they wander through the woods or downstream from one another. By wearing a brightly colored vest, the hunters or fishermen can better keep track of one another since the vests allow them to see each other from greater distances than they would otherwise be able to without the vests.

Even though these high-visibility safety vests greatly improve the chance that a wearer of the vest will be seen by others, certain limitations still exist. First, a brightly colored vest may be adequate for certain applications when used in a well-lit environment, but the ability for a colored vest to distinguish a wearer from the surrounding environment greatly diminishes as the ambient light also diminishes. As mentioned above, reflective tape is sometimes used to increase the visibility of a vest. This tape works well as long as the light source, i.e. headlights, is directed to the tape, but diminishes as the light source moves away from the reflective tape. This attribute of the reflective tape creates a hazard for workers in certain situations. For example, a person working at a location such as an intersection, where a vehicle might turn towards them only when it is already close to the worker, might not be seen until it is too late since the headlights of the vehicle will not shine in the direction of the worker until the vehicle turns in that direction.

Additionally, most safety vests described above will not aid sportsmen in keeping within sight of one another once ambient light diminishes to the point that the vest can no longer be seen. Reflective tape does not help in this situation as the person wearing the vest may be too far away from a person with a light source such as a flashlight.

There are safety vests that have self-illumination features, such as vests made by POLYBRITE INTERNATIONAL of Naperville, Ill. These vests and others with illumination features only provide a user with a single safety feature, namely illumination, manufactured in a single configuration. A user may have the option of turning the illumination on and off, but is left with the particular configuration of reflective tape and illumination sources established by the manufacturer. Additionally, light-emitting diodes (LEDs) are often left unprotected and susceptible to damage. Further, typical safety vests rely only on making the wearer more visible to the naked eye in order to make the wearer more perceptible and to enhance the safety of the wearer.

It is with respect that, these and other considerations that the various embodiments of the present invention have been made.

SUMMARY OF THE INVENTION

Aspects of the present invention address these problems and others by providing a safety garment that provides enhanced visibility of a wearer through protected LEDs, provides versatility through multiple configurations that allow a user to alter the arrangement of reflective tape and lights, provides audible alarms in addition to visual safety features, and provides for non-visual light emissions for use in situations requiring stealth.

According to one aspect of the present invention, a safety garment has first and second layers. The second layer is attached to the first layer and has a reflectance greater than that of the first layer. A plurality of lights are electrically connected to means for receiving a power source and providing power to the lights. Each light is positioned within an aperture of a protective cover such that the light does not protrude through the aperture past an outer surface of the protective cover.

According to another aspect of the present invention, a safety vest comprises a first mesh layer and a reflective tape having a reflectance greater than that of the first mesh layer. The reflective tape is detachably connected to the mesh layer. A plurality of LEDs are secured to the reflective tape and electrically connected to means for receiving a power source and providing power to the LEDs. Because the reflective tape with the plurality of LEDs is detachably connected to the mesh layer, a user may alter the configuration of the vest, including the quantity and location of the reflective strips and corresponding LEDs.

A further aspect of the present invention comprises a first layer and a plurality of LEDs secured to the first layer. Each LED is electronically connected to means for receiving a power source and providing power to the LED and is positioned within an aperture of a protective cover such that the light does not protrude through the aperture past an outer surface of the protective cover. The LEDs emit non-visible light. When activated, the LEDs are not visible to the naked eye, but are visible when means are used to detect light with wavelengths outside the visible range of an electromagnetic spectrum. This allows users to remain visible to each other when using devices to detect non-visible light, while maintaining stealth when necessary. These vests would be particularly useful to police officers, military personnel, and hunters.

These and various other features as well as advantages, which characterize the present invention, will be apparent from a reading of the following detailed description and a review of the associated drawings. It is to be understood that both foregoing general description and the following detailed description are exemplary and explanatory only and are not restrictive of the invention, as claimed.

DETAILED DESCRIPTION

The present invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

For people working or participating in sports or hobbies in close proximity to motor vehicles, aircraft, or other potential dangers, being visible could mean the difference between life and death. Aspects of the present invention provide improved safety garments to be utilized by police, firemen, airport ramp workers, department of transportation personnel, construction workers, refuse collectors, military personnel, hunters, hikers, runners, cyclists, and any other persons relying on enhanced visibility to ensure their safety. Safety garments according to aspects of the present invention provide users with increased visibility in low light conditions utilizing self-illumination that does not rely on reflecting light from sources outside of the garment. The garment illumination sources are protected, increasing the durability and life of the garment. According to various embodiments, the garment provides audible alarms in addition to visual illumination, detachable illumination, non-visible light illumination, as well as add-on illuminated lights, patterns, symbols, messages, beacons, and identification. Embodiments of the present invention provide personnel not only increased safety, but also increased utility through flexible options and features. It should be understood by those skilled in the art that while the following description utilizes a vest to illustrate embodiments of the present invention, the invention is equally applicable to other garments such as hats, belts, pants, and rain ponchos.

Figure 1:
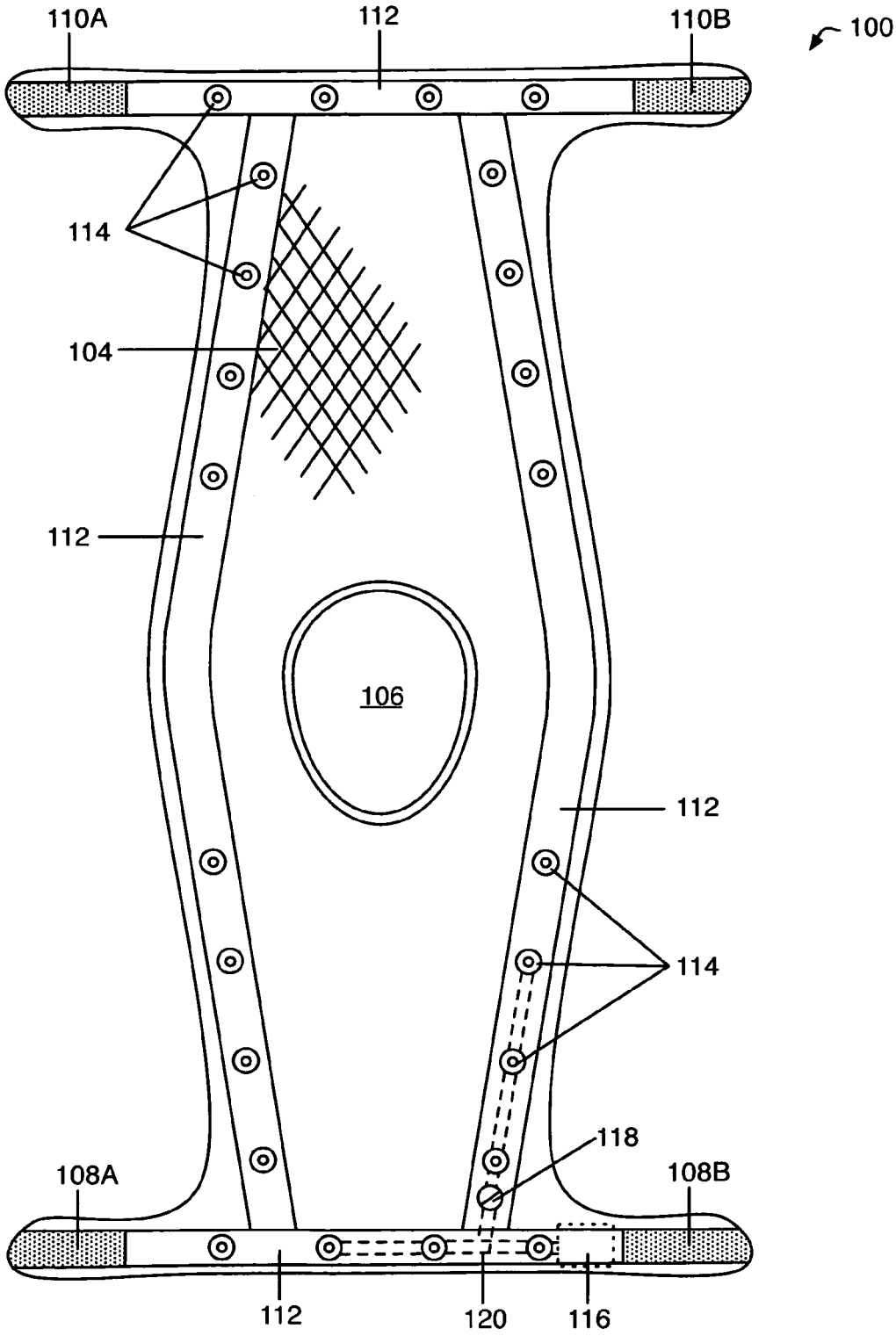
FIG. 1 is a top view of a safety vest illustrating attached reflective strips and LEDs in accordance with one embodiment of the present invention.

FIG. 1 illustrates a top view of the exterior of safety vest 100 according to one embodiment of the present invention. Safety vest 100 is preferably made from mesh 104 to allow air to penetrate the vest for the comfort of the wearer, but may be any other suitable material. To avoid confusion, only a portion of safety vest 100 shown in FIG. 1 is shown as mesh 104, but it is to be understood that the entire surface may be mesh. Mesh 104 may be a bright color to provide a sharp contrast with the surrounding environment of a wearer in order to attract attention, such as neon orange, neon green, or neon yellow. All materials are flame retardant. Safety vest 100 includes an aperture 106 through which the head of the wearer protrudes. After the wearer places his head through aperture 106, the safety vest 100 rests over the front and back of the wearer with the sides left open. The safety vest 100 is secured to the wearer using closing tabs 108 and 110. Front closing tabs 108 A and B are located on both sides of the bottom on the front of the vest. Similarly, rear closing tabs 110 A and B are located on both sides of the bottom on the rear of the vest. When the safety vest 100 is worn, the wearer will have a front closing tab 108 and a rear closing tab 110 on each side. Front closing tabs 108 A and B will secure to rear closing tabs 110 A and B respectively using any fastening means now known or developed in the future. Preferably, closing tabs 108 and 110 are secured to one another using hook and loop fasteners, but may also be secured using snaps, buttons, zippers, or any combination thereof. While the safety vest 100 shown in FIG. 1 is described as fitting over the head of a wearer and closing using tabs 108 and 110 on the sides, it should be appreciated that any vest design is equally applicable to the embodiments of the present invention described herein.

Safety vest 100 has a plurality of reflective strips 112 attached to the mesh 104. Reflective strips 112 add to the visibility of the vest since they have a reflectance that is greater than that of the mesh 104. Because reflective strips 112 reflect more light than mesh 104, they are more easily seen in low-light conditions with the aid of an outside light source such as the headlights of an automobile. Reflective strips 112 may be reflective tape that is sewn to mesh 104. Alternatively, reflective strips 112 may be detachably attached to the vest 100 as described below with respect to FIG. 4. Preferably, reflective strips 112 are a bright color that contrasts not only the surrounding environment, but also contrasts the color of mesh 104. As an example, mesh 104 may be neon orange, while reflective strips 112 are neon yellow. By using contrasting colors, more attention is drawn to the safety vest 100. It is to be understood, however, that mesh 104 and reflective strips 112 may be any color, including the same color.

While the colors of mesh 104 and reflective strips 112 draw attention to the wearer of safety vest 100 in daylight conditions, it is the increased reflectance of reflective strips 112 that enhances the safety of the wearer in low-light or nighttime conditions. In low-light conditions, lights that shine on reflective strips 112 is reflected, making strips 112 more perceptible than the surrounding environment. This increased reflectance is of great benefit to the wearer when located within close proximity to the path of an oncoming vehicle since the headlights of the vehicle will likely be reflected off of reflected strips 112 back to the driver of the vehicle, alerting the driver of the wearer. Reflective strips 112 meet American National Standards Institute (ANSI) standards.

To ensure that the wearer of safety vest 100 is seen at night without having to depend on a driver of a vehicle seeing reflected light from the headlights of the vehicle off of reflective strips 112, the vest includes a plurality of self-illuminating light assemblies 114. As seen in FIG. 1, light assemblies 114 are spaced apart along reflective strips 112. It should be appreciated that any number and location of light assemblies 114 may be used. Wires 120 electrically connect each light 114 to power source 116, located on the interior of safety vest 100. Only a portion of wires 120 are shown for clarity. Power source 116 is preferably three AA-sized batteries, but may be any number of or size of batteries sufficient to provide power to light assemblies 114 depending on the number and type of lights connected to the power source. A battery pack 116 rests in a pouch sewn to the interior of the vest 100. It is to be understood that alternate power sources may also be used such as solar power cells electrically connected to solar panels secured to the back of safety vest 100.

The electrical circuit comprised of the light assemblies 114, power source 116, and connecting electrical wires further includes on/off button 118. On/off button 118 is secured in a location within reflective strip 112 such that a wearer presses a marked location on a reflective strip to compress button 118 within the reflective strip in order to activate and deactivate the light assemblies 114. Reflective strips 112 comprise at least a top reflective surface and a backing. The on/off button 118 and the wiring connecting light assemblies 114 to the on/off button 118 and power source 116 are located between the top reflective surface and the backing of reflective strips 112. By locating the electrical components within reflective strips 112, the circuit components are hidden and protected from damage due to ordinary wear and tear from use of the vest. The electrical wiring exits a reflective strip 112 through an aperture to connect to power source 116. It is to be understood that on/off button 118 could protrude through a reflective strip 112, be a toggle or rocker switch, or be located on or proximate to the power source 116. By placing the on/off button 118 within a reflective strip on the front of the safety vest 100, the wearer has easy access to the button, while the button remains protected for durability purposes. It is also to be understood that the light assemblies 114 and corresponding wiring and circuitry may be located on vest 100 separate from reflective strips 112. Safety vest 100 may be water-resistant or waterproof if the electrical components are sealed and protected from moisture intrusion by means known in the art.

As one skilled in the art will appreciate, light assemblies 114 may be wired such that all lights remain on in a steady state, flash simultaneously in a regular on and off pattern, flash simultaneously in a pattern of any number of quick flashes followed by an off state of longer duration before repeating the pattern of quick flashes, flash in any type of regular or irregular pattern to include Morse Code or any other type of communicative code, flash in a programmed or random sequence, or any combination or variation thereof. The known circuitry for controlling the lights is located within a small box containing the power source 116 but may be located anywhere on vest 100. The lights in light assemblies 114 are preferably LEDs, but any other light source may be used. The lights in light assemblies 114 may be any color including red, blue, green, yellow, white, orange, or any combination thereof.

In an alternative embodiment, light assemblies 114 emit non-visible light such as infra-red or ultraviolet. In doing so, the vest 100 may be used by military personnel and hunters who wish to maintain stealth while remaining in visual contact with one another. By using night-vision goggles, binoculars, or a monocular as known in the art designed to detect light with wavelengths in the non-visual range on an electromagnetic spectrum, persons wearing vest 100 may be seen and distinguished from other persons and animals by the flashing lights that are unable to be seen by the naked eye. To further improve the stealthy characteristics of vest 100 for military or hunting embodiments, mesh 104 may be manufactured from a material such as cotton or other cloths that minimize any sound from the vest rubbing against clothing or objects in the environment as the wearer moves.

As seen in FIG. 1, reflective strips 112 are secured to the vest 100 in a belt and suspenders configuration. This configuration allows for increased visibility while allowing for room on the front and back of the vest for identification. For example, the vest 100 may be marked with the letters "POLICE," "DOT," "US ARMED FORCES," a company name, or any other identifying insignia corresponding to the wearer. Alternatively, mesh 104 may be marked with messages such as "CAUTION" or "SLOW." These identifiers and messages may be printed on the mesh 104 using a contrasting color, or may be created using reflective strips 112. It is to be understood that reflective strips 112 may be secured to mesh 104 in any pattern or configuration.

Figure 2:
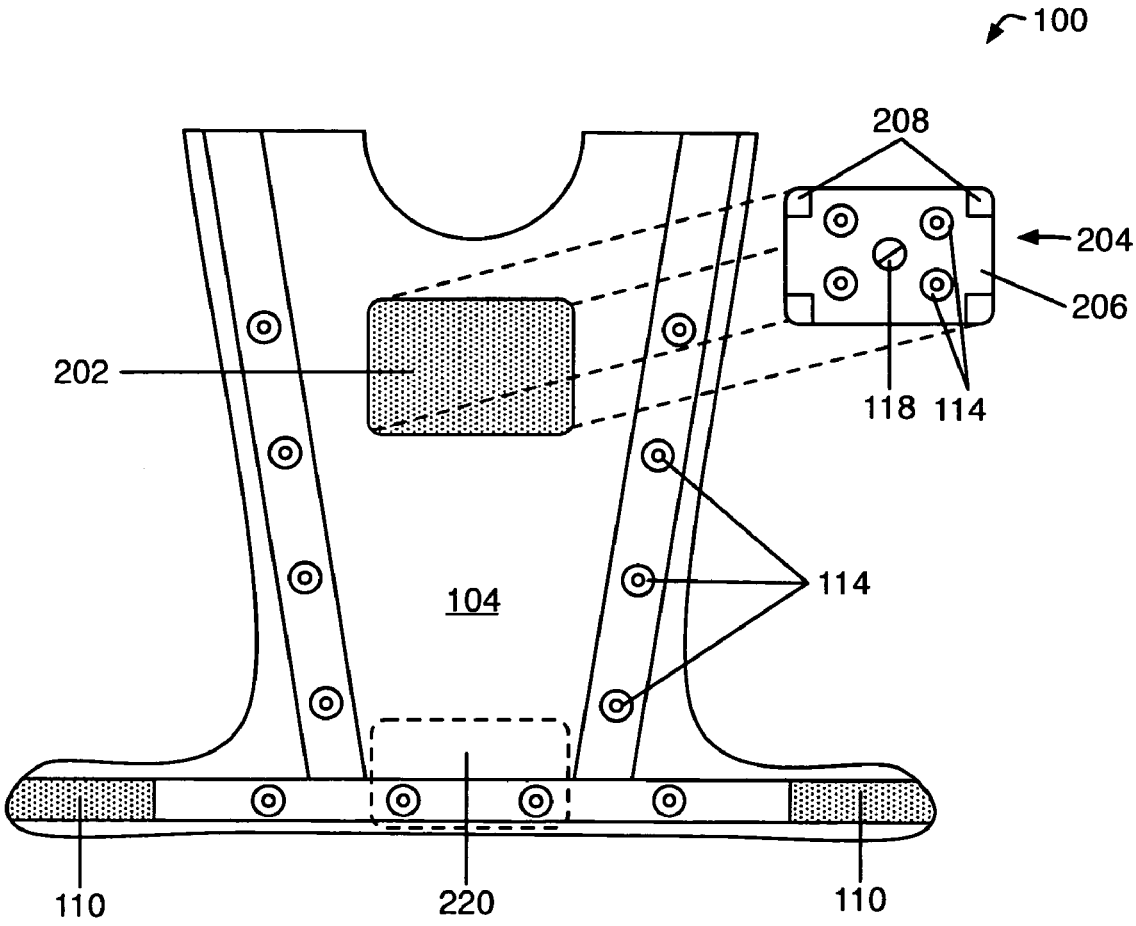
FIG. 2 is a back view of a safety vest illustrating a detachable LED patch in accordance with one embodiment of the present invention.

FIG. 2 shows a back view of safety vest 100 according to one embodiment of the present invention. Vest 100 includes attach means 202 and detachable LED patch 204. This embodiment allows a wearer to optionally add illuminated messages, identification, or beacons to the vest. This feature allows the wearer to use the vest 100 in a number of situations and to alter the configuration of the vest depending on the specific requirements of the given task. Attach means 202 may be a hook or loop patch, such as VELCRO, sewn to the mesh 104. The detachable LED patch 204 would have a corresponding hook or loop patch backing so as to quickly attach to vest 100. Additional attach means 202 includes but is not limited to snaps, buttons, zippers, tape, or any other means that would allow LED patches to be secured and removed.

LED patch 204 shown in FIG. 2 has LED configuration 206, which comprises four additional LEDs and on/off button 118. To power LED patches 204, each patch would preferably include its own power source. To minimize space, typical low-profile batteries such as those used in watches are used in sufficient number to provide the power required by the LEDs on the patch 204. LED patch 204 is preferably made from the same reflective material as reflective strips 112, providing space between the top reflective surface and the backing of the reflective material to house the circuitry associated with the LEDs. Alternatively, the patch 204 may be mesh or any other suitable material.

To provide further versatility to the wearer of safety vest 100, LED patch 204 includes magnets 208 secured between the reflective surface and the backing of the reflective material or externally to the patch 204. Magnets 208 allow the wearer to remove the patch and place it on the side of an automobile, sign, or any other appropriate metal surface given the particular situation. Alternatively, grommets may take the place of or supplement the magnets 208 in order to provide additional options for temporarily securing the patch 204 to an object separate from the safety vest 100.

Figure 2A:
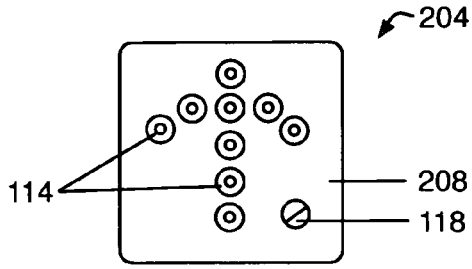
FIGS. 2A-2E are front views of LED patches for use with the safety vest of FIG. 2.
Figure 2B:
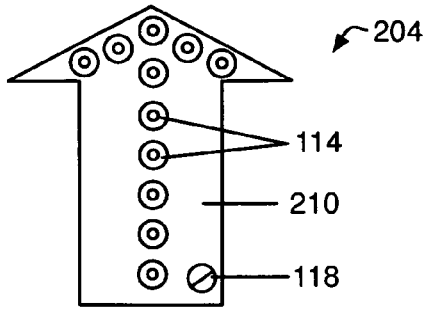
Figure 2C:
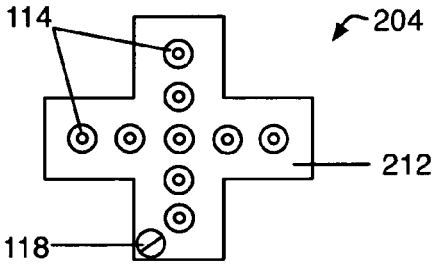
Figure 2D:
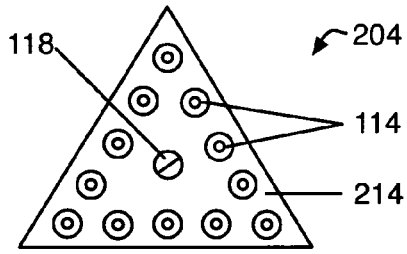
Figure 2E:
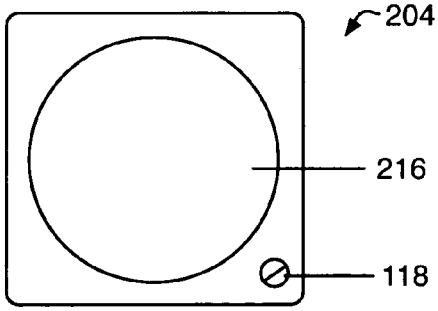

FIGS. 2A-2E illustrate examples of additional LED patches 204 that may be used with the vest embodiment shown in FIG. 2. FIG. 2A shows a patch 204 with LEDs configured in the shape of an arrow 208. This configuration is useful for directing traffic in one direction, i.e. around an accident. This patch and all others described here might also include magnets and grommets as described above with regards to FIG. 2. FIG. 2B shows a patch 204 similar in configuration as the patch in FIG. 2A, however, the shape of the patch itself is also an arrow 210. FIG. 2C shows a patch 204 in a cross configuration 212 to indicate medical personnel. FIG. 2D shows a patch 204 in a warning triangle configuration 214. Finally, FIG. 2E shows a patch 204 with beacon light 216. This patch includes a single large beacon light to further draw attention to the wearer of the vest.

A further embodiment for increasing the visibility of safety vest 100 includes fiber-optic thread sewn into vest 100 from light assemblies 114. Fiber-optic thread receives and transmits light from light assemblies 114 or from independent light sources as known in the art and may be sewn along the edges of vest 100 or in any pattern desired to provide additional illumination to vest 100.

Figure 3:
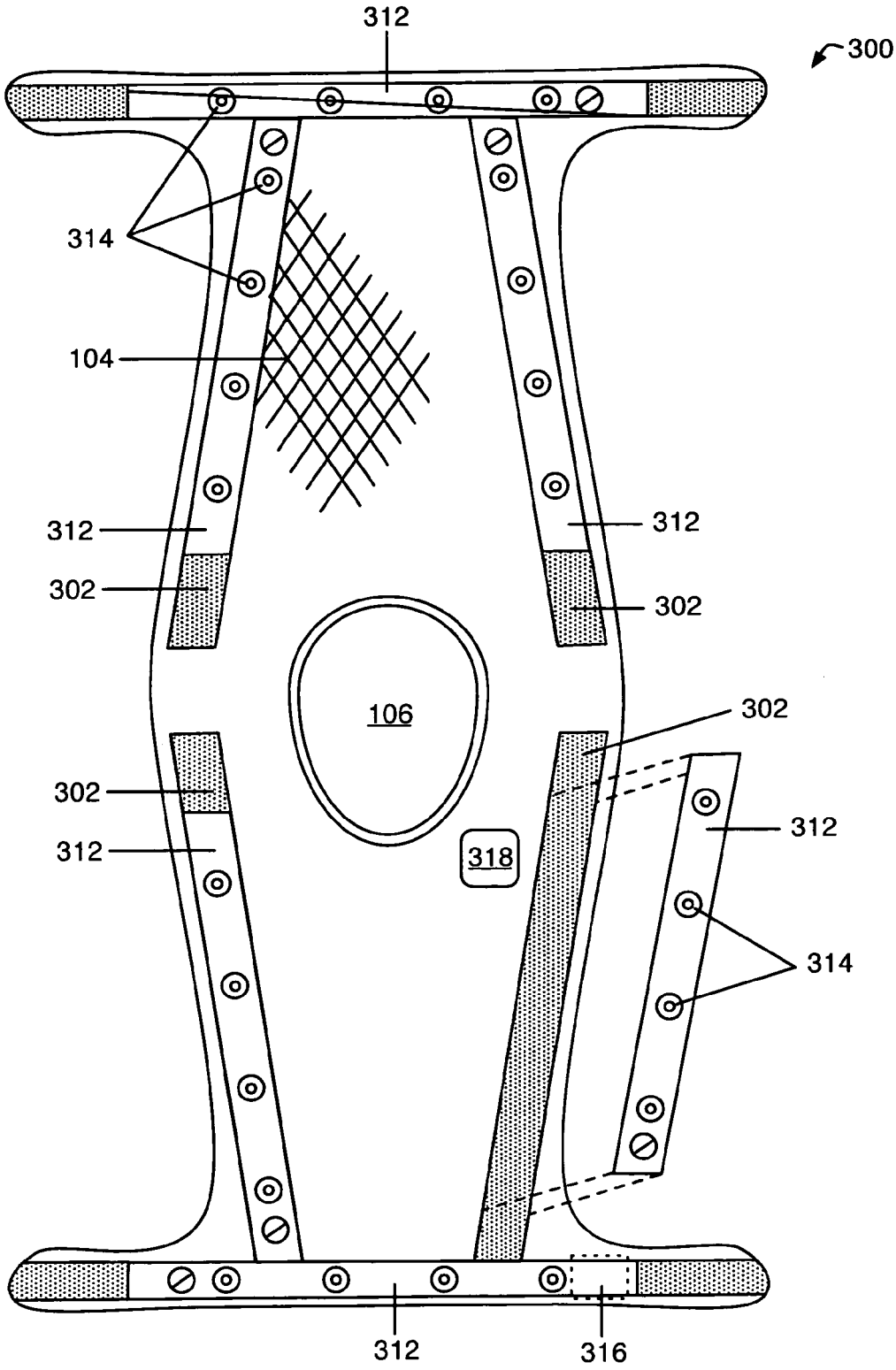
FIG. 3 is a partially exploded top view of a safety vest illustrating detachable reflective strips with LEDs in accordance with one embodiment of the present invention.

FIG. 3 illustrates a safety vest 300 with detachable reflective strips 312. In this embodiment, vest 300 includes attach means 302, such as hook or loop strips with corresponding hook or loop strips attached to a rear side of reflective strips 312. Additional attach means 302 includes but is not limited to snaps, buttons, zippers, tape, or any other means that would allow reflective strips 312 to be secured and removed. Similar to the embodiment shown in FIG. 1, reflective strips 312 include LEDs 314. LEDs 314 on each reflective strip 312 are powered through a power source specific to that reflective strip 312. Low-profile batteries are used in sufficient size and quantity to provide power to the LEDs 314 on the reflective strip. The circuitry is contained within the reflective strip 312, between a reflective surface and backing of the reflective strip 312.

Alternatively, safety vest 300 contains a single power source 316 located in a box resting within a pouch sewn to the interior of the vest 300. This power source is preferably AA-sized batteries in sufficient quantity to provide power to a maximum number of LEDs when the maximum number of reflective strips 312 is utilized. With this alternative, each reflective strip 312 includes an electrical plug to connect the circuitry within the reflective strip with the circuitry including the power source 316 in the vest 300. The electrical plug within each reflective strip would be connected to a receiving plug in the vest or in an adjacent reflective strip connected to a powered circuit. By having detachable reflective strips 312, a wearer can customize a safety vest to maximize its effectiveness for a specific task. There are certain tasks and activities that optimally have more or less illumination in certain locations on the vest.

Figure 4A:
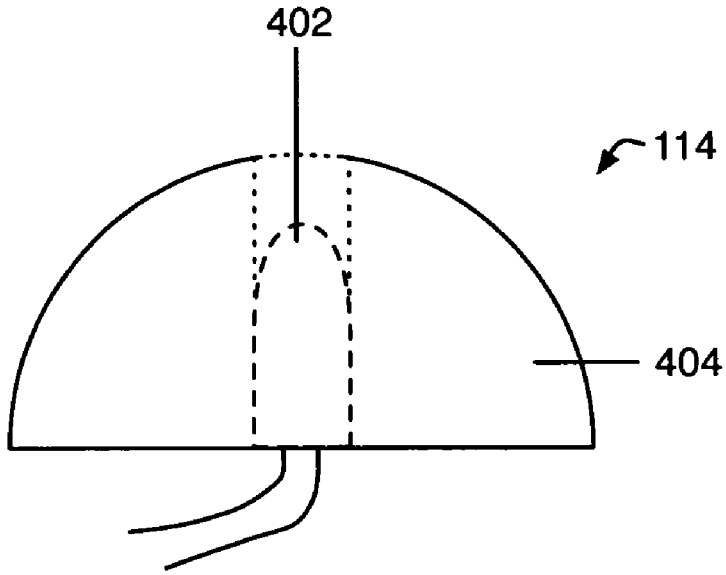
FIG. 4 is a side view of a LED within a protective cover in accordance with one embodiment of the present invention.
Figure 4B:
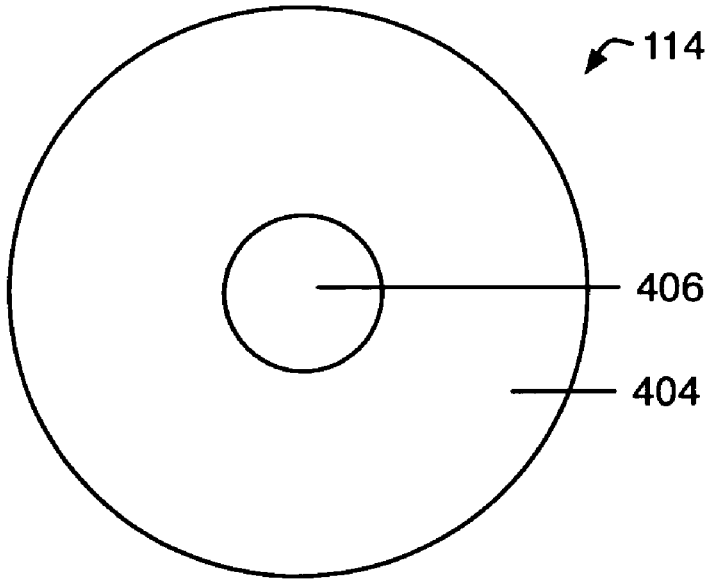

FIGS. 4A and 4B illustrate a light assembly 114 according to one embodiment of the present invention. Light assembly 114 comprises a LED 402 and protective cover 404. Protective cover 404, as seen in FIG. 4A, is dome shaped. However, it is to be understood that protective cover 404 may be any shape. Protective cover 404 is preferably made of a durable, scratch-resistant, heat-resistant material to ensure long life. Cover 404 is transparent or translucent to allow light from the LED within to emit light in all directions. Alternatively, cover 404 may allow for varying amounts of light to penetrate different portions of the cover. This feature may be useful to limit the amount of light seen by the wearer while maintaining maximum light penetration at all other viewing angles. Protective cover 404 has an aperture 406 in which the LED 402 is located. The LED 402 is recessed within the aperture 406 such that the LED does not protrude above the protective cover 404. This feature prevents the LED 402 from damage from being hit by objects or rubbed against objects separate from the vest. The LED 402 and protective cover 404 are secured to a reflective strip using adhesive, heat means, or any other appropriate methods. Each protective cover 404 and corresponding LED 402 is raised so that it protrudes away from the reflective strip to which it is attached. Being raised allows for the maximum amount of light emitted from each LED to be visible. Raising the LED 402 and protective cover 404 also allows for light from the LED to be reflected off of the reflective strip to which it is attached.

The versatility of a safety vest according to embodiments of the present invention is substantially increased over typical safety vests. As seen in FIG. 2, one embodiment of safety vest 100 includes pouch 220. Pouch 220 is preferably made of mesh and sewn to the inside rear of safety vest 100. It is to be understood that pouch 220 may be made from any material and secured in any location on vest 100, either permanently or detachably. Vest 100 may be folded into pouch 220 to minimize the size of vest 100 when not in use and to facilitate carrying. Securing means such as VELCRO loops may be incorporated on the exterior of pouch 220 to allow the vest 100 to be attached to a belt or belt loop when folded in pouch 220. Pouch 220 may alternatively be used to carry survival packs, first aid kits, or items such as spare batteries or flashlights. Additional pouches may be incorporated on vest 100 for these purposes.

Another feature of a safety vest according to one embodiment of the present invention that enhances the safety a wearer is audible device 318, shown in FIG. 3. Audible device 318 may be any device that produces an audible tone of sufficient volume to alert others of the presence of the vest wearer. Audible devices 318 may include a whistle or alarm with a corresponding panic button similar to hand-held panic alarms known in the art. Audible devices 318 are secured to vest 300 permanently through stitching, or detachably through any of the fastening means discussed above or in a pouch stitched to vest 300.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A safety garment, comprising:

a first layer having a first reflectance;

a second layer attached to the first layer, the second layer having a second reflectance greater than the first reflectance;

means for receiving a power source, said means for receiving a power source fixed to at least one layer wherein said layer is chosen from the group comprising said first layer and said second layer; and a plurality of lights secured to at least one layer wherein said layer is chosen from the group comprising said first layer and said second layer, each of the lights electrically connected to the power source receiving means, and each of the lights positioned within an aperture of a raised translucent protective cover such that the light does not protrude past an outer surface of the protective cover.

2. The safety garment of claim 1, wherein the first layer is mesh, the second layer is reflective tape, and the plurality of lights are a plurality of light emitting diodes (LEDs).

3. The safety garment of claim 2, wherein the reflective tape is detachably connected to the mesh.

4. The safety garment of claim 2, wherein the reflective tape comprises a top reflective surface and a backing and wherein the means for receiving a power source is electrical wiring located between the top reflective surface and the backing of the reflective tape.

5. The safety garment of claim 4, wherein the power source is a low-profile battery located between the top reflective surface and the backing of the reflective tape.

6. The safety garment of claim 2, further comprising a detachable lighted patch.

7. The safety garment of claim 6, wherein the detachable lighted patch displays a lighted symbol.

8. The safety garment of claim 6, wherein the detachable lighted patch comprises a flashing beacon larger than each of the plurality of LEDs.

9. The safety garment of claim 2, further comprising an audible alarm and means for activating the alarm.

10. The safety garment of claim 9, wherein the means for activating the alarm is a panic button electrically connected to the alarm.

11. The safety garment of claim 2, further comprising fiber-optic thread sewn into the mesh such that the fiber-optic thread emits light from at least one LED.

12. The safety garment of claim 1, wherein the plurality of lights are plurality of LEDs that emit non-visible light.

13. The safety garment of claim 1, further comprising a pouch attached to an inside surface of the first layer, the pouch sized for receiving the safety garment within.

14. The safety garment of claim 1, wherein said plurality of lights are a plurality of light emitting diodes (LEDs) that emit non-visible light.

15. The safety garment of claim 14 wherein the non-visible light is infrared light.

16. A safety vest, comprising:

a first layer comprising mesh with a first reflectance;

reflective tape detachably connected to the first layer, the reflective tape having a second reflectance greater than the first reflectance;

means for receiving a power source, said means for receiving a power source fixed to at least one layer wherein said layer is chosen from the group comprising said first layer and said second layer; and a plurality of LEDs secured to the reflective tape, each LED electrically connected to the power source receiving means.

17. The safety vest of clam 16, wherein the reflective tape attaches to the first layer using hook and loop fastening means.

18. The safety vest of claim 16, wherein the reflective tape is a plurality of reflective tape strips.

19. The safety vest of claim 18, wherein the power source and the means for receiving the power source is located within each tape strip of the plurality of reflective tape strips.

20. The safety vest of claim 18, wherein the power source is located within one tape strip of the plurality of reflective tape strips and each additional tape strip electrically connects to the tape strip with the power source.

21. The safety vest of claim 16 wherein said plurality of LEDs emit non-visible light.

22. The safety vest of claim 21 wherein said non-visible light is infrared light.

* * * * *